US007614986B2

(12) United States Patent
Mattox

(10) Patent No.: US 7,614,986 B2
(45) Date of Patent: Nov. 10, 2009

(54) ABDOMINAL EXERCISE DEVICE

(76) Inventor: Ernest Michael Mattox, 615 Waukazoo Ave., Petoskey, MI (US) 49770

( * ) Notice: Subject to any disclaimer, the term of this patent is extended or adjusted under 35 U.S.C. 154(b) by 0 days.

(21) Appl. No.: 11/846,157

(22) Filed: Aug. 28, 2007

(65) Prior Publication Data

US 2008/0058173 A1 Mar. 6, 2008

Related U.S. Application Data

(60) Provisional application No. 60/824,153, filed on Aug. 31, 2006.

(51) Int. Cl.
*A63B 26/00* (2006.01)

(52) U.S. Cl. ..... 482/140; 482/907

(58) Field of Classification Search ..... 482/92, 482/140–142, 907

See application file for complete search history.

(56) References Cited

U.S. PATENT DOCUMENTS 4,867,142 A * 9/1989 Jones ..... 601/115
5,163,890 A * 11/1992 Perry, Jr. ..... 482/142
5,183,452 A * 2/1993 Bacon et al. ..... 482/97
5,935,050 A * 8/1999 Shahan ..... 482/142
6,001,051 A * 12/1999 Chuan-Pin ..... 482/131
6,425,845 B1 * 7/2002 Varner ..... 482/123
6,692,418 B2 * 2/2004 Shahan ..... 482/144
6,726,607 B1 * 4/2004 Ihli ..... 482/127
7,044,898 B2 * 5/2006 Kuo et al. ..... 482/121
2006/0160683 A1 * 7/2006 Schenk ..... 482/907
2007/0287619 A1 * 12/2007 Tuller ..... 482/140

* cited by examiner

*Primary Examiner*—Lori Amerson
(74) *Attorney, Agent, or Firm*—McGarry Bair PC

(57) ABSTRACT

An abdominal exercise device comprises a center bar, a handle assembly attached to a first end portion of the center bar and that is adapted to be grasped by a user, an abdominal press assembly mounted to the center bar between first and second end portions thereof and having an abdominal contact surface that is spaced from the center bar and is adapted to rest against an abdominal region of a user; and a stabilizer mounted to the second end portion of the center bar and that is adapted to stabilize the center bar when the abdominal contact surface rests against a user. The user can perform a leg lift exercise, a crunch exercise, or both exercises in unison.

16 Claims, 10 Drawing Sheets

ABDOMINAL EXERCISE DEVICE

CROSS-REFERENCE TO RELATED APPLICATION

This application claims the benefit of U.S. provisional application Ser. No. 60/824,153, filed Aug. 31, 2006, which is incorporated herein by reference in its entirety.

BACKGROUND OF THE INVENTION

1. Field of the Invention

This invention relates to exercise devices. In one of its aspects, the invention relates to an exercise device designed to strengthen the abdominal muscles. In another of its aspects, the invention relates to an exercise device designed to strengthen the core and torso muscles.

2. Description of the Related Art

Exercise devices intended to improve a user's physique have grown in popularity over the past few decades. By providing increased resistance and structures that direct more efficient movements, such equipment enables users to increase their fitness level in a shorter amount of time than that associated with unassisted exercise. However, the home gyms and intricate systems of the past have made way for smaller, simpler devices aimed at strengthening and toning only certain anatomical zones.

Many people have a few "problem areas" that are harder to exercise and that naturally store excess fat. Rather than spend a significant portion of time working out the whole body, an individual may be more interested in targeting that specific area that he or she finds unsatisfactory. In recent years, abdominal exercise devices have become particularly popular, with infomercials showing before and after pictures of users and promising viewers that they too can achieve a "six-pack" stomach by purchasing and using the toted ware. These devices specifically target the muscles located in the stomach region and can range from a specially-made devices such as the Ab Rocker® to items as seemingly simple as oversized inflatable plastic balls.

As the variety of abdominal exercise equipment available for purchase has increased, companies have struggled to design devices that are both effective and affordable. In an effort to reduce costs and remain competitive, most devices have been built such that both size and function are fixed. This has proved rather problematic, as different people require slight adjustments in the size of the device. In addition, the toning and strengthening ability of traditional abdominal exercise devices is limited because the abdominal muscles cannot all be exercised with one simple movement. Common abdominal exercise devices only enable unidirectional movement that fails to work the extremities of the abdominal region, leaving key areas such as the oblique muscles and lower abs flabby. Because users also tend to push their stomachs outward when exercising their abdominal region, it is difficult to tone the abdominal muscle without building additional muscle outward, which makes the gut appear even larger. The most common problem associated with abdominal exercise equipment is that it fails to support the back and spine, causing soreness and even injury.

SUMMARY OF THE INVENTION

According to the invention, an abdominal exercise device comprises a center bar assembly having first and second ends, a handle assembly attached to the first end of the center bar assembly and having a grip that is adapted to be grasped by a user, an abdominal press assembly mounted to the center bar assembly between the first and second ends thereof and having an abdominal contact surface that is mounted to the center bar assembly and is adapted to rest against an abdominal region of a user and a stabilizer mounted to the second end of the center bar and is adapted to stabilize the center bar assembly when the abdominal contact surface rests against a user. Typically, a user lays face upward on a horizontal support surface or rests against an inclined support surface.

In one embodiment, the stabilizer comprises a leg support that is adapted to support the legs of a user who is lying on a support surface. In another embodiment, the stabilizer comprises an anchor that is adapted to be fixed with respect to a user and connected to the second end of the center bar. Further, the anchor can comprise a pivotal mounting and can also include a brace between the anchor and the second end of the center bar. In addition, the anchor can include a support that fits beneath the user and mounts the pivotal mounting. The support can be a flat plastic or wooden board or metal plate. Alternately, the pivotal mounting can be attached to a floor or table, preferably through a releasable mounting.

In another embodiment, the center bar is adjustable along the length thereof. The center bar can include first and second telescoping bars and an adjusting connector to selectively fix the position of the first telescoping bar with respect to the second telescoping bar.

In yet another embodiment, the abdominal press is adjustably mounted for movement along the length of the center bar. Preferably, the abdominal contact surface is mounted to a support bar for adjustable movement with respect to the center bar.

In yet another embodiment, the abdominal press can be mounted for adjustable movement along a length of the center bar. Further, the abdominal press can include a spacer bar that spaces the abdominal contact surface from the center bar. Further, the spacer bar includes portions that are adjustable to selectively adjust the length of the spacer bar. Further, the abdominal press further includes a connector mounted to the center bar for adjustable movement of the abdominal press along a length of the center bar. In addition, the abdominal press can include a pivotal mounting between the abdominal contact surface and the spacer bar for pivotal adjustment of the abdominal contact surface with respect to the elongated center bar during use of the abdominal exercise device.

In still another embodiment, the stabilizer comprises a leg support that is adapted to support the legs of a user whose back is positioned against a support surface and an anchor that is adapted to be fixed with respect to a user and is adapted to be connected to the second end portion of the center bar to stabilize the second end of the center bar with respect to a user, wherein the leg support and the anchor are alternately removably mountable to the second end portion of the center bar. Further, the brace that is pivotally mounted to the anchor.

The device can be operated from a back-supported seated position or when lying flat on the back. A user holds onto the handle and places his or her legs over or alongside the leg assembly with the abdominal press facing into and pressing upon the torso. The user performs a leg lift exercise, a crunch exercise, or both exercises in unison while holding the device in this manner. The leg lift exercise can be assisted by the leg assembly.

DESCRIPTION OF THE PREFERRED EMBODIMENT

Figure 1:
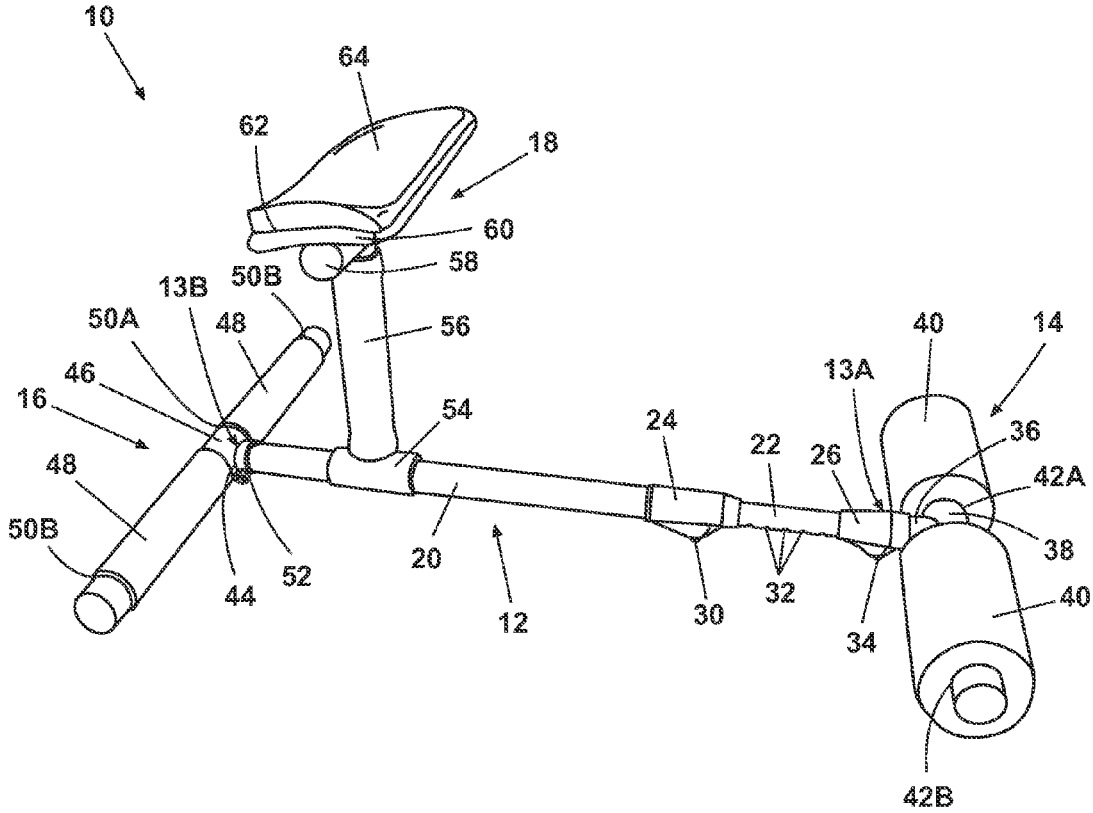
FIG. 1 is a perspective view of an exemplary embodiment of the abdominal exercise device of the invention.

Referring to FIGS. 1-8, an abdominal exercise device 10 comprises a center bar assembly 12, a leg assembly 14, a handle 16, and an abdominal press 18. The center bar assembly 12 has an adjustable length and extends along a horizontal axis. The center bar assembly 12 is designed to adjust to a variety of lengths that would be needed to accommodate users of different heights. The leg assembly 14 is attached to an end 13A of the center bar assembly 12 and has an orientation in the same horizontal plane and transverse to the center bar assembly 12. The leg assembly 14 is adapted to accommodate a user's legs. The handle 16 is coupled to an opposite end 13B of the center bar assembly 12 and has an orientation in the same horizontal plane and transverse to the center bar assembly 12. The handle 12 is designed to be gripped by a user's hands. The abdominal press 18 is slidably coupled to the center bar assembly 12 intermediate the leg assembly 14 and handle 16. The abdominal press 18 extends transverse to the center bar assembly 12 and to the plane that includes the center bar assembly 12, the leg assembly 14 and the handle 16.

Figure 2:
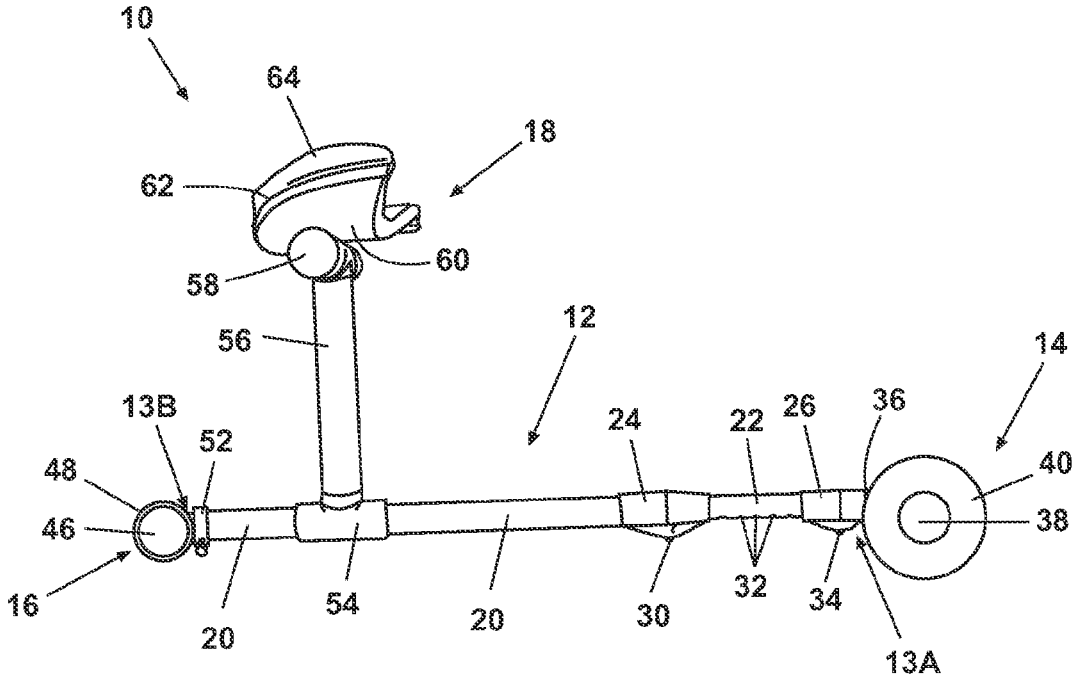
FIG. 2 is a side view of the abdominal exercise device of FIG. 1.

In a first embodiment of the invention shown in FIGS. 1 and 2, the center bar assembly 12 comprises an outer bar 20, a telescoping inner bar 22, an adjusting connector 24, and a leg assembly connector 26. The outer bar 20 extends from one end 13B into the adjusting connector 24. The inner bar 22 then extends from the adjusting connector 24 to the leg assembly connector 26 at the second end 13A. The outer bar 20 and inner bar 22 are preferably hollow and cylindrical in shape and are formed of any suitably rigid or resilient material, such as extruded plastic or metal. The inner bar 22 has a diameter smaller than that of the outer bar 20 and is maintained in a telescoping relationship with the outer bar 20 by the adjusting connector 24. The adjusting connector 24 can be formed of any material having suitable rigidity and strength for the purposes described herein. The adjusting connector 24 is fixedly attached to a portion of the outer bar 20 and is adapted to slidably receive the inner bar 22. The adjusting connector 24 includes a raised button 30 and an inwardly-biased detent (not shown). The detent is biased inwardly by a spring or any other suitable means. The button 30 is coupled to the detent in a manner that moves the detent outwardly when the button 30 is pressed. The detent is adapted to fit into any one of a plurality of notches 32 located in the outer surface of the inner bar 22.

The leg assembly connector 26 is formed of any material having suitable rigidity and strength for the purposes described herein. The leg assembly connector 26 is fixedly attached to the inner bar 22 and is adapted to removably receive a post 36 of the leg assembly 14. The leg assembly connector 26 includes a raised button 34 coupled to an inwardly-biased detent (not shown) in a manner that moves the detent outwardly when the button 34 is pressed. The detent is biased inwardly by a spring or any other suitable means. The detent is adapted to fit into a groove (not shown) located on the post 36 for 360° rotation of the post 36 about the leg assembly connector 26.

The leg assembly 14 further comprises a post 36, a leg bar 38, and two leg cushions 40. The post 36 is primarily cylindrical in shape and can be formed of any suitably rigid material, such as molded plastic. The post 36 is attached to the leg bar 38 by any suitable means, such as by glue. The post 36 can also be formed integrally with the leg bar 38, which is also formed of a suitably rigid material, such as molded plastic. The leg bar 38 is a cylindrical bar that is preferably hollow and has closed ends. The leg bar 38 is oriented perpendicular to and in the same horizontal plane as the post 36. The post 36 also bisects the leg bar 38. Extending outwardly along each half of the leg bar 38 are two thick leg cushions 40 preferably formed of a lightweight and non-rigid foam. The leg cushions 40 are cylindrical in shape and are adapted for slidable insertion of a portion of the leg bar 38 therethrough. The leg cushions 40 can be secured to the leg bar 38 by any suitable means, such as by glue. Each leg cushion 40 is preferably dimensioned so as to extend from a point 42A spaced far enough from the post 36 to accommodate the leg assembly connector 26 to a point 42B before the end of the leg bar 38. As discussed previously, the post 36 is removably and rotably retained by the leg assembly connector 26 by means of the detent adapted to fit the groove in the post 36.

The handle 16 comprises a post 44, a handle bar 46, and two hand cushions 48. The post 44 is cylindrical in shape and is formed of any suitably rigid material, such as molded plastic. The post 44 is attached to the handle bar 46 by any suitable means, such as by glue or welding. The post 36 can also be formed integrally with the handle bar 46, which is also formed of a rigid material, such as molded plastic. The handle bar 46 is a cylindrical bar that is preferably hollow and has closed ends. The handle bar 46 is oriented perpendicular to and in the same horizontal plane as the post 44. The post 44 also bisects the handle bar 46. Extending outwardly along each half of the handle bar 46 are two thin hand cushions 48 preferably formed of lightweight and flexible foam. The hand cushions 48 are cylindrical in shape and are adapted for slidable insertion of a portion of the handle bar 46 therethrough. The hand cushions 48 can be secured to the handle bar 46 by any suitable means, such as by glue. Each hand cushion 48 is preferably dimensioned so as to extend from a point 50A spaced far enough from the post 44 to accommodate the outer bar 20 to a point 50B spaced from the end of the handle bar 46. The post 44 is coupled to the outer bar 20 of the center bar assembly 12 for 360° rotation of the post 44 with respect to the outer bar 20. This rotational mounting is preferably accomplished by forming the post 44 to have a diameter slight smaller than that of the outer bar 20 so as to create a reasonably tight fit when the post 44 is inserted into the outer bar 20. A metal clamp 52 can be tightened around the portion of the outer bar 20 contained the post 44 to maintain the post 44 in a desired rotational position with respect to the outer bar 20.

The abdominal press 18 comprises a hollow tube 54, a spacer bar 56, a cushion bar 58, a cushion support 60, and an abdominal cushion 64. The hollow tube 54, spacer bar 56, and cushion bar 58 are all preferably hollow and cylindrical in shape, and are formed of any suitably rigid material, such as molded plastic. The hollow tube 54, spacer bar 56, and cushion bar 58 can be formed integrally, or they can be formed separately and then connected by any suitable means, such as glue or welding. The hollow tube 54 is slidably mounted on the outer bar 20. The inner diameter of the hollow tube 54 is approximately equal to that of the adjusting connector 24. The hollow tube 54 is mounted on the outer bar 20 prior to attachment of the handle 16 such that it is retained on the outer bar 20 by the adjusting connector 24 on one side and the clamp 52 or handle 16 on the other. The hollow tube 54 can rotate 360° around the outer bar 20. The spacer bar 56 extends outwardly from the hollow tube 54 and is oriented transverse to and adjacent the hollow tube 54. The cushion bar 58 is located on the end of the spacer bar 56 farthest from the hollow tube 54 and is oriented transverse to the spacer bar 56. The cushion bar 58 is also oriented parallel to the leg bar 38 and handle bar 46. The cushion support 60 is a thin, slightly curved member formed of a rigid material, such as molded plastic. The cushion support 60 is adapted for its outermost surface 62 to comfortably transmit pressure through the abdominal cushion 64 onto a user's torso and abdominal region. The cushion support 60 is oriented such that in its normal position, its longest axis is parallel to the longest axis of the cushion bar 58. The cushion support 60 is pivotally attached to the cushion bar 58 through a pin (not shown) for movement about a longitudinal axis extending through the spacer bar 56. The abdominal cushion 64 is dimensioned to fit against and fully cover the outermost surface 62 of the cushion support 60. The abdominal cushion 64 is formed of a flexible material, such as relatively soft foam, and is fixedly attached to the cushion support 60 by any suitable means, such as glue.

Figure 10:
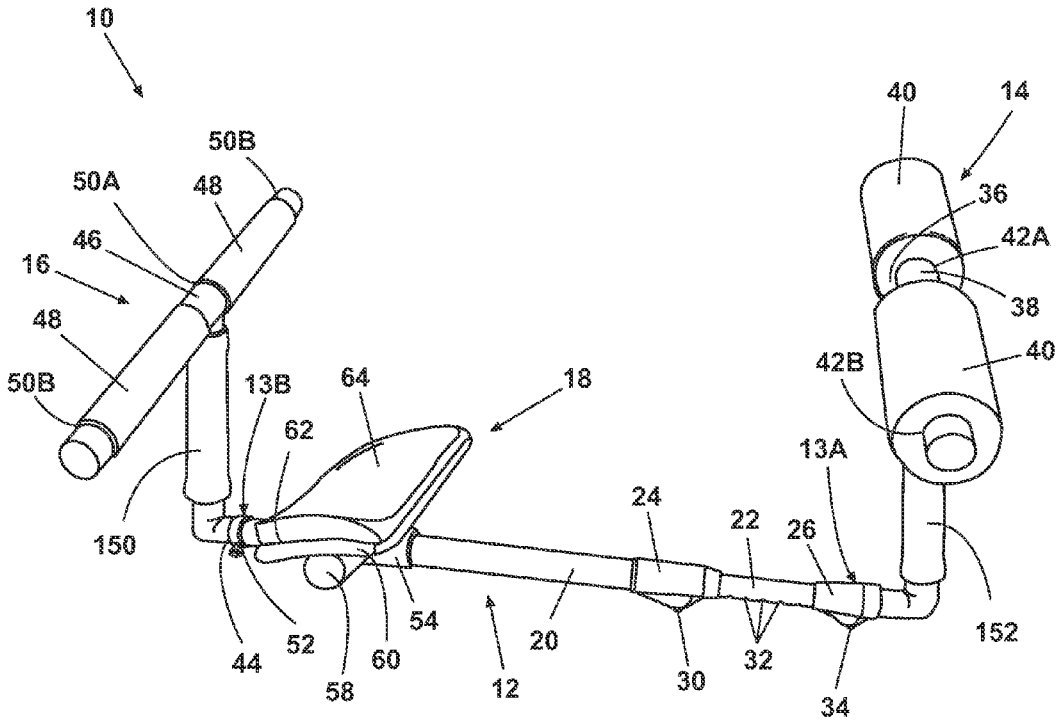
FIG. 10 is a perspective view, like FIG. 1, of a modification to the embodiment illustrated in FIGS. 1 and 2 according to the invention.

In another embodiment illustrated in FIG. 10, where like numerals are used to describe the same parts, the abdominal press 18 is fixed to the hollow tube 54 on the center bar assembly 12 and the spacer bar 56 can be eliminated so that the cushion support bar 58 is attached directly to the hollow tube 54 or directly to the tube 20 in a basic form of the invention. In addition, a spacer bar 150 is attached transverse to the outer tube 20 at one end of thereof and the handle 16 is mounted to another end of the spacer bar 150 to space the handle 16 from the user. In addition, a spacer bar 152 is mounted at one end to the other end of the center bar assembly 12 and at another end to the leg assembly 14 to space the leg assembly away from the user. The important feature is that an abdominal contact surface is adapted to rest against an abdominal region of a user while the handle 16 is spaced from the user to provide leverage to the user with respect to the abdominal contact surface while exercising.

Referring now to FIGS. 3-7, the center bar assembly 12 comprises a main bar 80. The main bar 80 extends from one end 13A to the other end 13B. The main bar 80 is preferably hollow and has a square or rectangular cross-section. The center bar is shown as straight or elongated but can also be curved upwardly at the ends. The main bar 80 can be formed of any material having suitable strength and rigidity for the purposes described herein. An exemplary material would be steel. A plurality of apertures 82 are spaced along the top and bottom sides of the main bar 80 such that each aperture 82 on the top is aligned with an aperture 82 on the bottom.

Figure 3:
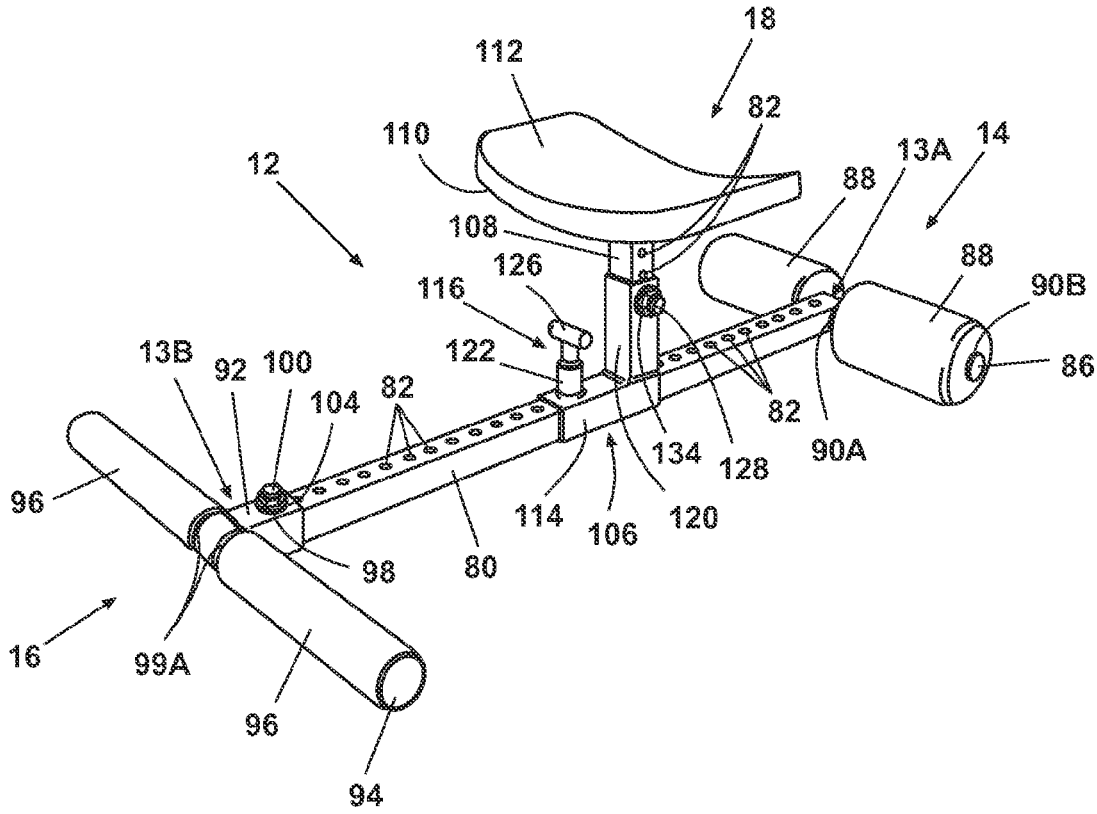
FIG. 3 is a perspective view of an alternative embodiment of the abdominal exercise device according to the invention.
Figure 4:
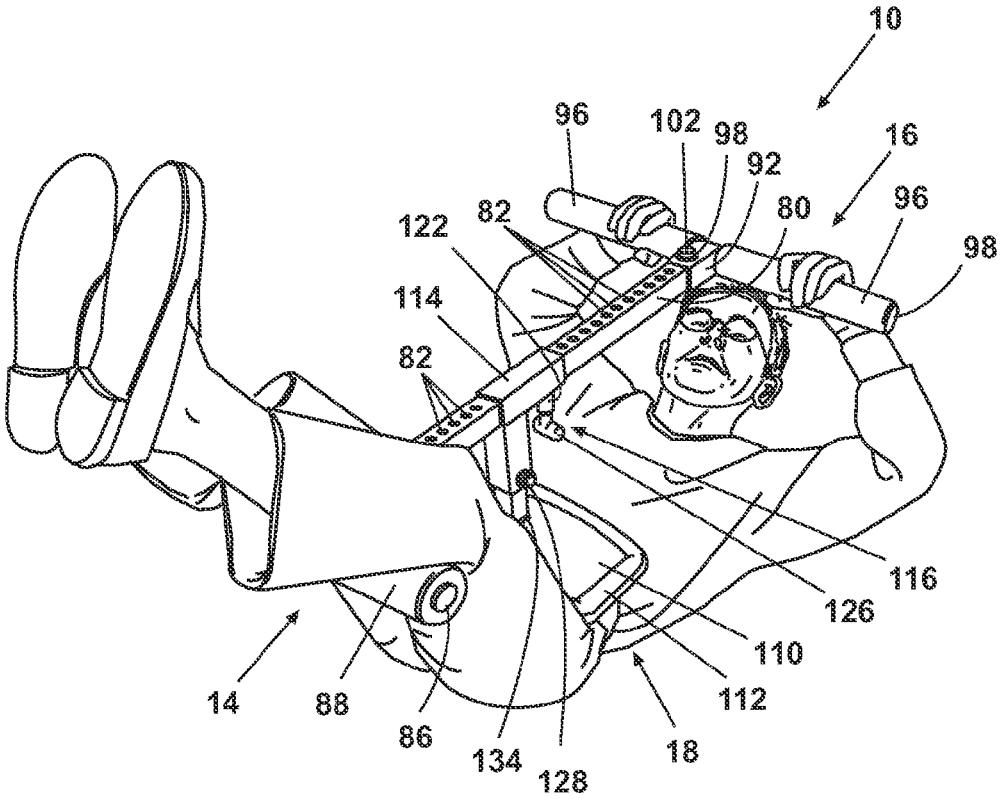
FIG. 4 is a perspective view of the abdominal exercise device of FIG. 3 being used to perform a crunch exercise.

Also shown in FIG. 3, the leg assembly 14 comprises a leg rod 86 and two leg cushions 88. The leg rod 86 is a cylindrical rod that is preferably hollow and has closed ends. The leg rod 86 is oriented perpendicular to and adjacent the main bar 80 such that the main bar 80 bisects the leg rod 86. The leg rod 86 is formed of a rigid material, such as steel. Preferably, the main bar 80 and leg rod 86 are formed integrally. Alternatively, the leg rod 86 can be formed separately and attached to the main bar 80 by any suitable means, such as welding. Extending outwardly along each half of the leg rod 86 are two thick leg cushions 88 formed of lightweight and flexible foam. The leg cushions 88 are cylindrical in shape and are adapted for slidable insertion of a portion of the leg rod 86 therethrough. The leg cushions 88 can be secured to the leg rod 86 by any suitable means, such as glue. Each leg cushion 88 is preferably dimensioned so as to extend from a point 90A adjacent the main bar 80 to a point 90B before the end of the leg rod 86.

The handle 16 comprises a connecting post 92, a handle rod 94, two hand cushions 96, two washers 98, a threaded bolt 100, and a nut 102. The post 92 has a cross section similar in shape but slightly larger than that of the main bar 80 and is formed of any suitably material, such as plastic or metal, flexible, resilient or rigid The handle rod 94 is a cylindrical rod that is preferably hollow and has closed ends. The handle rod 94 is oriented perpendicular to and in the same horizontal plane as the post 92. The handle rod 94 is preferably formed of a rigid material, such as steel. Preferably, the main post 92 and handle rod 94 are formed integrally. Alternatively, the post 92 and handle rod 94 can be formed separately and attached to the main bar 80 by any suitable means, such as welding. The post 92 also bisects the handle rod 94. Extending outwardly along each half of the handle rod 94 are two thin hand cushions 96 preferably formed of lightweight and non-rigid foam. The hand cushions 96 are cylindrical in shape and are adapted for slidable insertion of a portion of the handle rod 94 therethrough. The hand cushions 96 can be secured to the handle rod 94 by any suitable means, such as sliding onto the handle rod 94. Each hand cushion 96 is preferably dimensioned so as to extend from a point 99A spaced far enough from the post 92 to accommodate the main bar 80 to a point 99B before the end of the handle rod 94.

The handle 16 is attached to the main bar 80 by the post 92. The bolt 100 is a generally conventional bolt having a first threaded end and a second end terminating in a bolt head. Two openings 104 adapted to receive the body of the bolt 100 therethrough are located on the top and bottom of the post 92 and are aligned with each other. The openings 104 are of a size small enough to prevent the head of the bolt 100 from passing through but large enough to permit the body of the bolt 100 to enter. The body of the bolt 100 is of a size small enough to fit through the apertures 82 on the main bar 80. A washer 98 having a central opening and also adapted to accommodate the body of the bolt 100 therethrough is placed about each opening 104 on the outer surface of the post 92. Additionally, the openings 104 are positioned such that when the post 92 is placed about the end 13B of the main bar 80, the openings 104 align with a pair of apertures 82 on the main bar 80. The bolt 100 can then be inserted through the aligned openings 104 and apertures 82. The nut 36 is a small cylinder or block having a threaded hole adapted for threadably receiving the threaded end of the bolt 100. Once the bolt 100 is inserted through to the opposite side, the threaded end of the bolt 100 is threaded into the nut 102. Tightening of the bolt 100 in the nut 102 clamps the assembly together so that the post 92 bears tightly against the main bar 80. Removal of the handle 12 requires loosening and removing the bolt 100 from the nut 102, withdrawing the bolt 100 from the openings 104 and apertures 82, and pulling the post 92 away from the main bar 80.

In one embodiment, the abdominal press 18 comprises an adjusting assembly 106, a spacer bar assembly 118, a cushion support 110, and an abdominal cushion 112 forming an abdominal contact surface. The adjusting assembly 106 comprises a sliding member 114 and a detent assembly 116. The spacer bar assembly comprises a spacer bar 108 and a distancing rod receiving member 120. The sliding member 114 and receiving member 120 each have a cross section similar in shape but slightly larger than that of the main bar 80 and are formed of any suitably rigid material, such as steel or plastic. Preferably, the sliding member 114 and receiving member 120 are formed integrally. Alternatively, they can be formed separately and attached by any suitable means, such as welding. The sliding member 114 is adapted to be slidable along the main bar 80. The sliding member 114 is placed around the main bar 80 prior to attachment of the handle 16 such that it is retained on the main bar 80 by the leg rod 86 on one side and the post 92 on the other. The receiving member 120 extends outwardly from the sliding member 114 and is oriented perpendicular to the sliding member 114. The position of the sliding member 114 on the main bar 80 is maintained by the detent assembly 116. The detent assembly 116 is formed of any materials and attached to the sliding member 114 by any suitable means and in any location suitable for the purposes described herein. The detent assembly 116 comprises a housing 122, an inwardly-biased detent (not shown), and a detent-releasing handle 126. The housing 122 is preferably a hollow cylinder adapted to surround the detent and receive a portion of the handle 126. The inwardly-biased detent is adapted to fit into any one of the apertures 82 on the main bar 80. The detent is biased into an aperture 82 by a spring or any other suitable means. The handle 126 coupled to the detent in a manner that causes the detent to move outwardly of the aperture 82 when the handle 126 is pulled. The slidable connection between the sliding member 114 and the main bar 80 can be eliminated, if desired, so that the abdominal press assembly 18 is relatively fixed with respect to the main bar 80.

The spacer bar 108 has a structure preferably identical to that of the main bar 80, including apertures 82, except it is shortened. The spacer bar 108 is received by the receiving member 120. Attachment of the spacer bar 108 to the receiving member 120 is accomplished using a threaded bolt 128 and a nut 130. The bolt 128 is a generally conventional bolt having a first threaded end and a second end terminating in a bolt head. The nut 130 is a small cylinder or block having a threaded hole adapted for threadably receiving the threaded end of the bolt 128. Two openings 132 adapted to receive the body of the bolt 128 therethrough are located on opposite sides of the receiving member 120 and are aligned with each other. The openings 132 are of a size small enough to prevent the head of the bolt 128 from passing through. A washer 134 having a central opening and also adapted to accommodate only the body of the bolt 128 therethrough is placed about each opening 132. Additionally, the openings 132 are positioned such that when the spacer bar 108 is placed within the receiving member 120, the openings 132 align with a pair of apertures 82 on the spacer bar 108. The bolt 128 can then be inserted through the aligned openings 132 and apertures 82. The threaded end of the bolt 128 is threaded into the nut 130. Tightening of the bolt 128 in the nut 130 clamps the assembly together so that the receiving member 120 bears tightly against the spacer bar 108. Removal of the spacer bar 108 requires loosening and removing the bolt 128 from the nut 130, withdrawing the bolt 128 from the openings 132 and apertures 82, and pulling the spacer bar 108 away from the receiving member 120.

The cushion support 110 is a thin, slightly curved member formed of a suitable rigid or flexible material material such as steel, aluminum or plastic and adapted for its outermost surface 136 to comfortably transmit pressure through the abdominal cushion 112 onto a user's torso and abdominal region. The cushion support 110 is attached to the outermost end of the spacer bar 108 by any suitable means, such as by welding. The cushion support 110 is oriented such that its longest axis is perpendicular to the main bar 80. The abdominal cushion 112 is dimensioned to fit against and fully cover the outermost surface 136 of the cushion support 110. The abdominal cushion 112 is formed of a non-rigid material, such as a relatively soft foam, and is fixedly attached to the cushion support 110 by any suitable means, such as glue.

Figure 8:
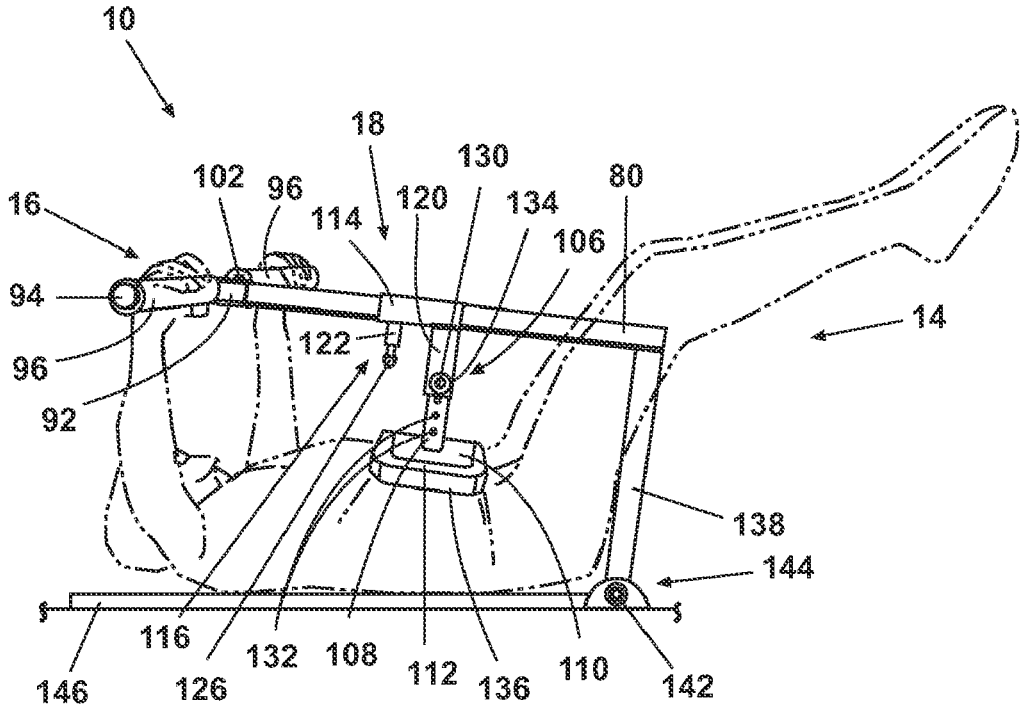
FIG. 8 is a side view of a third embodiment of the abdominal exercise device having a back pad and showing proper placement of the device.
Figure 9:
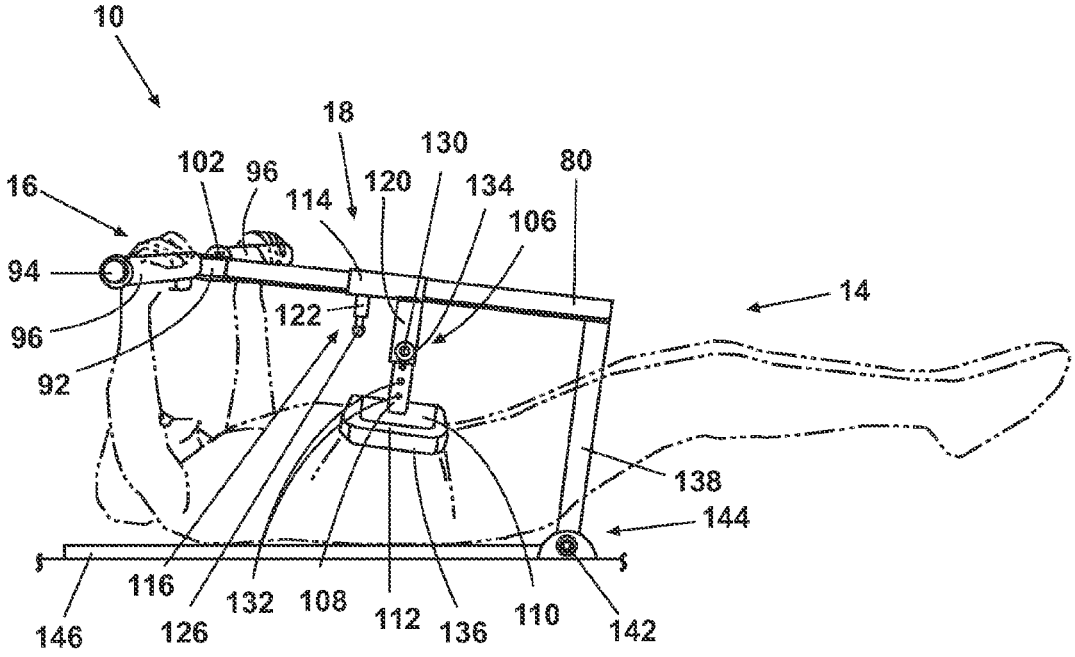
FIG. 9 is a side view of the abdominal exercise device of FIG. 8 being used to perform a leg lift exercise.

In a third embodiment of the invention shown in FIGS. 8 and 9 where like numbers are used to describe like parts, the leg rod 86 can be replaced with a brace 138 and an anchor 144 to stabilize the second end of the center bar with respect to a user. In one embodiment, the anchor 144 comprises a pivotal mounting 142 and support 146 that is attached to the pivotal mounting 142. The support 146 can be wood, plastic or metal sheet of sufficient strength to mount the pivotal mounting 142. A back pad 140 can be placed onto the support 146. Alternatively, the anchor assembly can comprise the pivotal mounting itself that is fixed to or adapted to be removably fixed to a support surface such as a table or floor. The brace 138 has a structure and composition similar to that of the main bar 80. The brace 138 fixedly attaches to the main bar 80 by any suitable means, such as by welding. Alternatively, the brace 138 can be made removably attachable to the main bar 80 by any suitable means, such as by forming the brace 138 to create a snap fit onto the main bar 80. In this manner, a user can switch back and forth from the leg rod 86 and leg assembly 14 and the anchor assembly 144. When connected and in use, the brace 138 typically has a vertical orientation although other orientations are also within the scope of the invention. The brace 138 extends from the main bar 80 down to the back pad 140. The brace 138 is rotatably coupled to the support 146 by a pivoting mechanism 142 that enables the brace 138 to pivot forward and backward about the pivoting mechanism 142. The back pad 140 is sized to comfortably accommodate a portion of the back side of a user's body and is preferably rectangular in shape, although the shape can vary within the scope of the invention. The back pad 140 is preferably formed of a lightweight and flexible foam. In the illustrated embodiment, the back pad 140 is sized to accommodate a user's entire back side, including the head, back, and buttocks.

In order to use the device 10, a user can first adjust the positioning of the various elements of the device 10. Some users may be taller than other users, so it may be convenient to adjust the hands, legs, and torso reach the handle 16, leg assembly 14, and abdominal press 18 respectively. In the first embodiment of the invention, the length of the center bar assembly 12 can be adjusted by pressing and holding the button 30 on the adjusting connector 24. Once the button 30 is pressed, the detent moves out of the notch 32, enabling movement of the inner bar 22. The inner bar 22 can then be pulled away from the adjusting connector 24 to increase the length of the center bar assembly 12. In the event it is necessary to decrease the length of the center bar assembly 12, the inner bar 22 can be pushed into the adjusting connector 24. Once a desirable length has been achieved, the button 30 is released. In the event that the detent is not aligned with a notch 32 in the new position, the inner bar 22 can be pushed or pulled until the detent springs into the nearest notch 32. The abdominal press 18 can also be repositioned by holding the outer bar 20 in one hand and firmly gripping the spacer bar 56. Force can be applied to the spacer bar 56 in a direction parallel to the outer bar 20 that will cause the hollow tube 54 to move along the outer bar 20 to the desired position. Force can also be applied to the handle 12 and leg assembly 14 to cause the handle bar 46 and leg bar 38 respectively to rotate about an axis through the center bar assembly 12.

In order to adjust the device 10 according to the second and third embodiments of the invention, the user can alter both the position of the adjusting assembly 106 on the main bar 80 and the length of the spacer bar 108 extending outside of the receiving member 120. To adjust the position of the adjusting assembly 106 on the main bar 80, a user must hold firmly onto the sliding member 114 with one hand. With the other hand, the user can pull outwardly on the handle 126 to withdraw the detent from its position inside one of the apertures 82. With the handle 126 still pulled outward, the hand holding onto the sliding member 114 can apply force to the sliding member 114 to cause it to move along the main bar 80. Once a satisfactory position has been achieved, the user can release the handle 126. In the event that the detent is not aligned with an aperture 82 in the new position, the sliding member 114 can be pushed or pulled along the main bar 80 until the detent springs into the nearest aperture 82. To adjust the length of the spacer bar 108 extending outside of the receiving member 120, a user must first remove the nut 130 from the threaded end of the bolt 128. The bolt 128 can then be withdrawn from the apertures 82 and openings 132. A user can then slide the spacer bar 108 to a satisfactory position inside the receiving member 122, at which point the bolt 128 can be reinserted. The bolt 128 is rethreaded into the nut 130, and the nut 130 is tightened to clamp the assembly together so that the receiving member 120 bears tightly against the spacer bar 108.

When the device 10 has been adjusted to best accommodate the user's size, the user can sit in a chair or against a suitable support surface or lay flat on his or her back to use the first, second, or third embodiments, as shown in FIGS. 4-9. The device 10 is held in a manner in which the abdominal cushion of the abdominal press 18 faces into the torso, and the handle 16 is positioned near the upper body, as is also shown in FIGS. 4-9. The leg assembly 14 is positioned near the lower body. The handle 16 is held onto with one hand on each hand cushion. In the first and second embodiments shown in FIGS. 4-7, the user's legs are placed so that the back side of each knee rests on one of the leg cushions 88. In the third embodiment of the invention shown in FIGS. 8 and 9, the user's legs are placed on either side of the brace 138.

Figure 5:
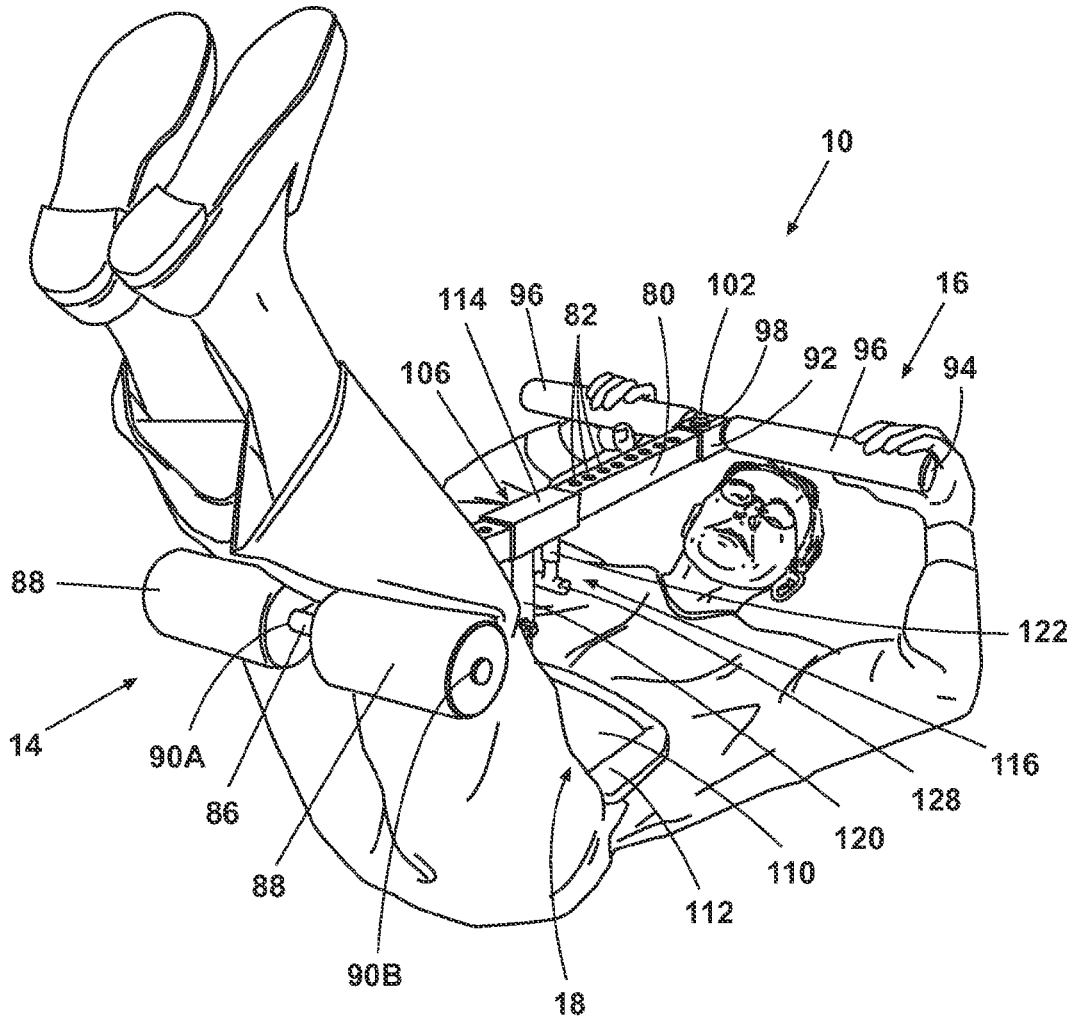
FIG. 5 is a perspective view of the abdominal exercise device of FIG. 3 being used to perform a leg lift exercise.
Figure 6:
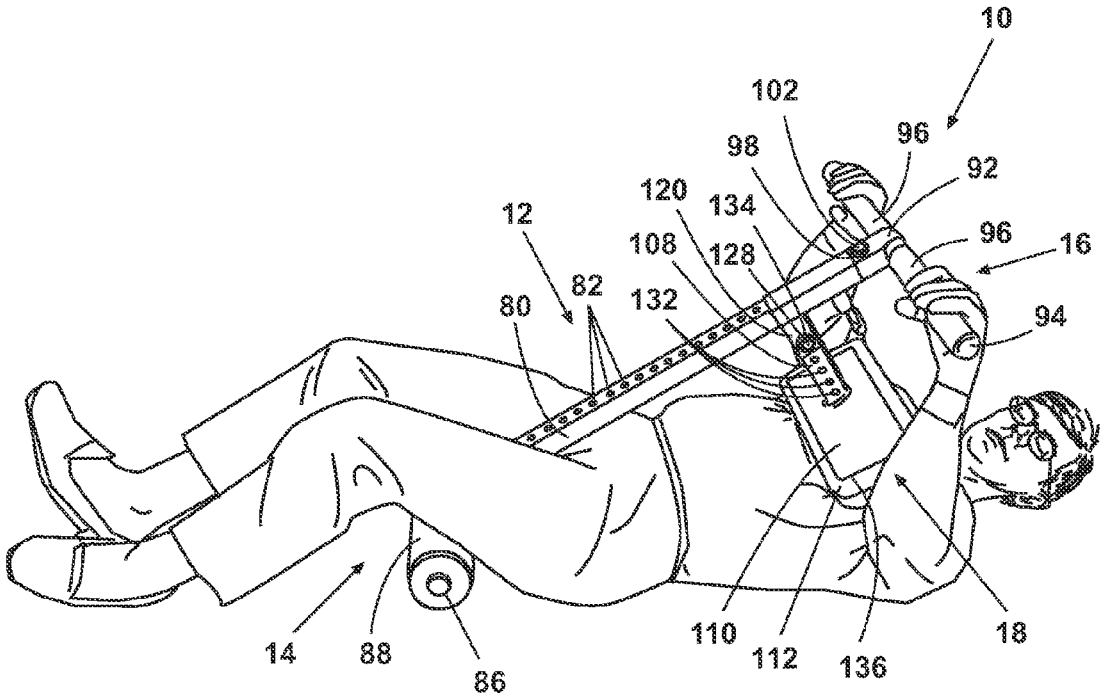
FIG. 6 is a perspective view of the abdominal exercise device of FIG. 3 being used to perform a combination leg lift and crunch exercise.
Figure 7:
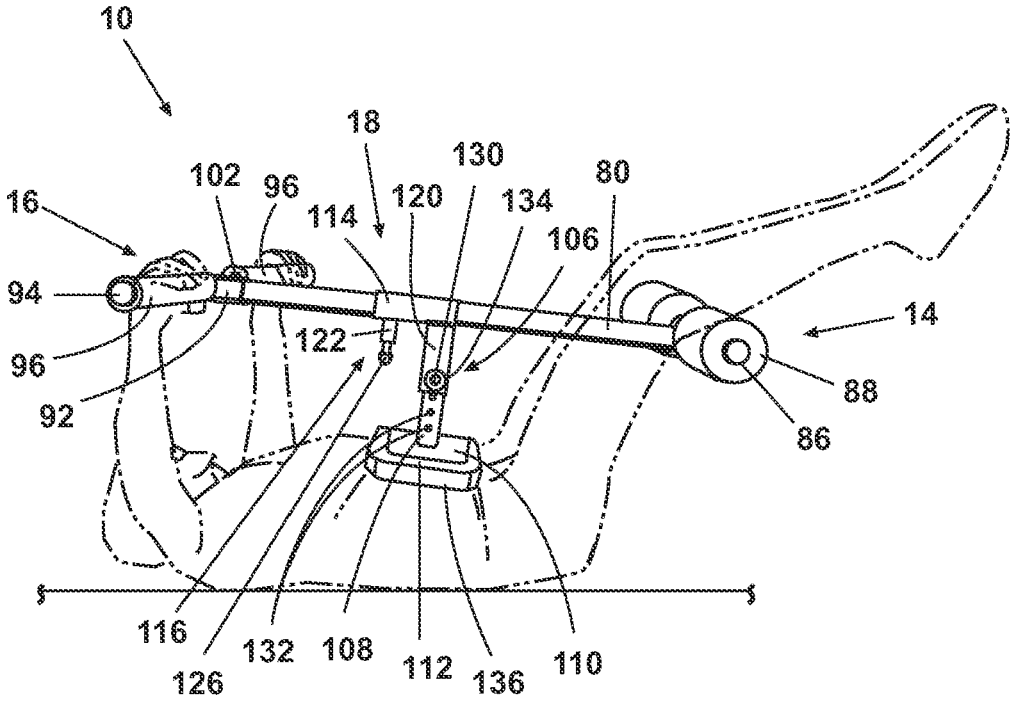
FIG. 7 is a side view of the abdominal exercise device of FIG. 3 and showing proper placement of the device.

Once in position, the user can then perform one of three types of exercises. To perform a leg lift exercise as shown in FIGS. 5 and 9, the user lifts the legs to a raised position. For the first and second embodiments of the invention, the abdominal press 18 acts as a pivot point and the center bar assembly 12 can rotate about the pivot point. In this manner, the hands can assist with the leg lift by applying downward force to the handle 16 to lift the leg assembly 14. The leg cushions 88 push upward into the back of the knees, urging the user's legs upward. To perform a leg lift exercise as shown in FIG. 9, the user lifts the legs to a raised position while holding onto the handle 16. At the same time, the user must maintain his or her legs in a relatively raised position. The leg lift exercise shown in FIG. 9 is more difficult than the leg lift exercise shown in FIG. 5 because there are no leg cushions 88 for assisting with the leg lift as illustrated in FIG. 9. The user can also decrease the height of the leg lift in order to increase the level of difficulty of the leg lift. In FIG. 5, a user is shown doing a less difficult leg lift. In FIG. 9, a user is shown doing a more difficult leg lift. The higher the level of difficulty of the leg lift, the more effective the leg lift will be at strengthening and toning the user's muscles.

To perform a crunch exercise as shown in FIGS. 4 and 6-9, a user lifts his or her torso upward into the abdominal press 18 while the hands pull slightly downward on the handle 16 to keep the device 10 pressed against the body. For added difficulty, a user can pull forcefully downward on the handle 16. In the first and second embodiments, the leg assembly 14 is prevented from moving upward by the user's legs. In the third embodiment, the vertical leg bar 138 rotates about the pivoting mechanism 142 to move forward when a user moves his or her body upward, and then backward as the user returns to a position lying on the back pad 140.

A user can also perform both a leg lift and crunch exercise in combination, as shown in FIG. 9. To perform this exercise, a user lifts both the legs and torso in unison while using the hands to pull the device 10 into the body. For the first and second embodiments of the invention, the hands can assist with the leg lift by applying downward force to the handle 16 to lift the leg assembly 14 as discussed previously.

The device 10 of the invention benefits users in many ways. In order to tone and improve the physique, users can perform a leg lift exercise to target the lower abs, a crunch exercise to target the upper abs, or a combination thereof. By adjusting the height of the leg lift, the user can also adjust the difficulty of the leg lift exercise. In addition, by rotating the leg assembly 14 or handle 16 slightly, a user can also exercise the oblique muscles, which are typically harder to tone and strengthen. The adjustability of the device 10 enables users perform exercises comfortably regardless of body shape or size, and also enables more efficient targeting of specific muscle groups.

The abdominal exercise device is also an excellent method of toning the abdominal region for older individuals and individuals with back problems because the device creates a pressure on the abdominals that stabilizes the back and spine against the mat, chair, back pad 140, or other surface against which the user is pressed. The total force on the back and spine during crunches and leg lifts is thus reduced during use of the device as compared to the force associated with other methods. Force is not directed to one specific point, but is instead spread along the stabilized and flattened back and spine. Moreover, when the leg bar 38 or leg rod 86 are attached, users can perform an assisted leg lift exercise; this further reduces any detrimental strain on the back and spine, and also enables even the least physically fit of users to perform the exercise successfully.

The pressing of the abdominal press 18 into the abdominals also generates intense muscle flexing and stabilization. The lower and mid-torso become a solid, anchored core while the leg lift motion works the lower abs and the crunch exercise works the upper abs. Additionally, the hands can pull downward on the handle 16 to increase the pressure on the abs.

The safety and speedy results associated with the abdominal exercise device have yet to be produced by any other exercise equipment. There has never been a device or abdominal exercise routine that prepared the abdominals, back, and spine to receive a resistive force from a leg lift or crunch motion. Not only are the abdominal muscles, back, and spine made ready for work and stabilized by the device 10, but the resistance loading to the abdominal muscles is vastly increased. The increased safety and efficiency of the device enables strengthening and toning of the abdominals never before reachable.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An abdominal exercise device for a user in a back-supported position comprising:

a center bar having first and second end portions;

a handle assembly immovably mounted at least in a longitudinal direction to the first end portion of the center bar and that is adapted to be grasped by the bands of a user who is in a back-supported position on a support surface;

an abdominal press mounted to the center bar between the first and second end portions thereof and having an abdominal contact surface that is spaced from the center bar and is adapted to rest against an abdominal region of the user who is in a back-supported position on a support surface;

a stabilizer mounted to the second end portion of the center bar to stabilize the center bar when the abdominal contact surface rests against a midsection of a user who is in a back-supported position on a support surface, wherein the stabilizer comprises an anchor that is connected to the second end portion of the center bar to stabilize the second end of the center bar with respect to a user; and wherein the stabilizer further comprises a brace between the anchor and the second end of the center bar.

2. An abdominal exercise device according to claim 1 wherein the anchor includes a support that forms the support surface, fits beneath the user and is mounted to the brace.

3. An abdominal exercise device for a user in a back-supported position comprising:

a center bar having first and second end portions;

a handle assembly immovably mounted at least in a longitudinal direction to the first end portion of the center bar and that is adapted to be grasped by the hands of a user who is in a back-supported position on a support surface;

an abdominal press mounted to the center bar between the first and second end portions thereof and having an abdominal contact surface that is spaced from the center bar and is adapted to rest against an abdominal region of the user who is in a back-supported position on a support surface;

a stabilizer mounted to the second end portion of the center bar to stabilize the center bar when the abdominal contact surface rests against a midsection of a user who is in a back-supported position on a support surface, wherein the stabilizer comprises an anchor that is connected to the second end portion of the center bar to stabilize the second end of the center bar with respect to a user; and wherein the stabilizer comprises a leg support that is adapted to support the legs of a user whose back is positioned against a support surface; wherein the leg support and the anchor are alternately removably mountable to the second end portion of the center bar.

4. An abdominal exercise device according to claim 3 and further comprising a brace that is pivotally mounted to the anchor.

5. An abdominal exercise device for a user in a back-supported position comprising:

a center bar having first and second end portions;

a handle assembly immovably mounted at least in a longitudinal direction to the first end portion of the center bar and that is adapted to be grasped by the hands of a user who is in a back-supported position on a support surface;

an abdominal press mounted to the center bar between the first and second end portions thereof and having an abdominal contact surface that is spaced from the center bar and is adapted to rest against an abdominal region of the user who is in a back-supported position on a support surface; and a stabilizer mounted to the second end portion of the center bar to stabilize the center bar when the abdominal contact surface rests against a user's midsection who is in a back-supported position on a support surface, wherein the stabilizer comprises an anchor that is connected to the second end portion of the center bar to stabilize the second end of the center bar with respect to a user;

wherein the anchor comprises a pivotal mounting and the stabilizer further comprises a brace between the pivotal mounting and the second end of the center bar.

6. An abdominal exercise device according to claim 5 wherein the anchor includes a support that forms the support surface, fits beneath the user-and is mounted to the pivotal mounting.

7. An abdominal exercise device according to claim 5 wherein the pivotal mounting is adapted to be mounted to a floor or table.

8. An abdominal exercise device according to claim 7 wherein the pivotal mounting is adapted to be releasably mounted to a floor or table.

9. An abdominal exercise device according to claim 5 wherein the anchor is adapted to be mounted to a floor or table.

10. An abdominal exercise device according to claim 5 wherein the center bar is adjustable along a length thereof.

11. An abdominal exercise device according to claim 10 wherein the center bar comprises first and second telescoping bars and an adjusting connector to selectively fix the position of the first telescoping bar with respect to the second telescoping bar.

12. An abdominal exercise device according to claim 5 wherein the abdominal press is mounted for adjustable movement along a length of the center bar.

13. An abdominal exercise device according to claim 5 wherein the abdominal press includes a spacer bar that spaces the abdominal contact surface from the center bar.

14. An abdominal exercise device according to claim 13 wherein the spacer bar includes portions that are adjustable to selectively adjust the length of the spacer bar.

15. An abdominal exercise device according to claim 13 wherein the abdominal press further includes a connector mounted to the center bar for adjustable movement of the abdominal press along a length of the center bar.

16. An abdominal exercise device according to claim 15 wherein the abdominal press further includes a pivotal mounting between the abdominal contact surface and the spacer bar for pivotal adjustment of the abdominal contact surface with respect to the elongated center bar during use of the abdominal exercise device.

* * * * *